United States Patent [19]

Taniguchi

[11] 4,068,786

[45] Jan. 17, 1978

[54] SHOULDER BABY BAG

[75] Inventor: Susumu Taniguchi, Tokyo, Japan

[73] Assignee: King Baby Corporation, Winston-Salem, N.C.

[21] Appl. No.: 714,658

[22] Filed: Aug. 16, 1976

[51] Int. Cl.[2] ..... A47D 13/02

[52] U.S. Cl. ..... 224/6; 5/344; 150/33; 190/2; 190/58 B; 190/48; 224/47

[58] Field of Search ..... 224/6, 47, 49, 52, 55, 224/8, 9, 58, 26 R; 150/33; 5/93 R, 93 B, 344; 190/2, 42, 58 B, 57, 58 R, 48, 28 R

[56] References Cited

U.S. PATENT DOCUMENTS

| | | | |
|---|---|---|---|
| 2,540,165 | 2/1951 | Fiel | 5/344 X |
| 2,577,670 | 12/1951 | Adams | 190/48 |

FOREIGN PATENT DOCUMENTS

| | | | |
|---|---|---|---|
| 28,323 | 8/1930 | Australia | 224/9 |
| 809,583 | 7/1931 | Germany | 224/6 |

*Primary Examiner*—Robert J. Spar
*Assistant Examiner*—Donald W. Underwood
*Attorney, Agent, or Firm*—Cushman, Darby & Cushman

[57] ABSTRACT

A shoulder baby bag comprising: a pair of first covers made in the form of a generally inverted triangle and spaced apart from and in opposing relation with each other; a second cover made in the form of a generally rectangle and stitched to the side edges of the first covers for defining a cavity with the first and second covers; a third cover made in the form of a generally rectangle and having one end stitched to the upper edge of one of the first covers and side edges zippedly associated with the upper edges of the second cover, the third cover further having the other end extending to the upper edge of the remaining first cover and being swingable around the one end of the third cover when the side edges of the third cover is dissociated from the upper edges of the second cover; a tongue cover in the form of a generally rectangle and having one end stitched to the lower portion of the second cover and the other end fastenable to the one end with a sufficient length to wrap the second cover and third cover; and a shoulder strap having ends secured to the upper portions of the first covers.

10 Claims, 8 Drawing Figures

SHOULDER BABY BAG

This invention relates to a shoulder baby bag which is used for carrying an infant or baby together with diapers, cloths, papers and the like.

Conventionally, it was found a hard labour for a woman to carry the infant or baby together with a bag containing diapers, cloths, papers and the like which are required to take the baby on a short journey. If the woman carried jointly the baby and the bag, the baby was frequently forced to be carried under an unnatural posture, which might result in femoral dislocation to the baby. Moreover, the woman's sight was hindered depending upon the posture of the baby carried by the woman.

It is therefore an object of the present invention to provide a shoulder baby bag which is adapted easy for the woman to carry the infant or baby together with a bag containing diapers, cloths, papers and the like.

It is another object of the present invention to provide a shoulder baby bag which make it possible for the woman to carry the baby without causing femoral dislocation to the baby.

It is a further object of the present invention to provide a shoulder baby bag which by no means worsens the woman's sight upon carrying the baby.

In order to overcome such objects of the present invention, a shoulder baby bag is proposed as comprising: a pair of first covers made in the form of a generally inverted triangle and spaced apart from and in opposing relation with each other; a second cover made in the form of a generally rectangle and stitched to the side edges of the first covers for defining a cavity with the first and second covers; a third cover made in the form of a generally rectangle and having one end stitched to the upper edge of one of the first covers and side edges zippedly associated with the upper edges of the second cover, the third cover further having the other end extending to the upper edge of the remaining first cover and being swingable around the one end of the third cover when the side edges of the third cover is dissociated from the upper edges of the second cover; a tongue cover in the form of a generally rectangle and having one end stitched to the lower portion of the second cover and the other end fastenable to the one end with a sufficient length to wrap the second cover and third cover; and a shoulder strap having ends secured to the upper portions of the first covers.

The shoulder strap of the shoulder baby bag may comprise first male and female straps which have one ends attached in folded relation with each other to the outer surface of one of the first covers, the first male strap being disposed between the first female strap and one of the first covers and having the other end provided with a buckle having a pin member, and the first female strap being disposed outwardly of the first male strap and having a plurality of holes arranged in its longitudinal direction to be engageable with the pin member of the buckle of the first male strap and having a length longer than that of the first male strap; second male and female straps which have one ends attached in folded relation with each other to the outer surface of the remaining first cover, the second female strap being disposed between the second male strap and the remaining first cover and having a plurality of holes arranged in its longitudinal direction, and the second male strap having the other end provided with a buckle having a pin member to be selectively engageable with one of the holes formed in the first female strap and one of the holes formed in the second female strap and having a length longer than that of the second female strap; a first intermediate connecting ring held by the first male and female straps with the first male strap engaging the first female strap; a second intermediate connecting ring held by the second male and female straps with the second male strap engaging the second female strap; and a third strap having one end held by the first intermediate connecting ring and the other end held by the second intermediate ring with its longitudinal length adjustable.

The shoulder baby bag may further comprise a baby holder having both ends lockably engaged with the first and second intermediate connecting rings to hold a baby on the third cover.

The baby holder of the shoulder baby bag may include a ring strap provided above the third cover with a pair of locking devices to be connectable with the first and second intermediate connecting rings, a center strap having both ends secured to the ring strap to be drooped toward the third cover, and a net formed into a generally inverted mountain shape and having an upper ends secured to the entire length of the ring strap, the net being formed with a pair of bores to be inserted by legs of a baby.

The shoulder baby bag may further comprise: a pair of first hard plate each having substantially the same size as the first cover and respectively provided at the inner sides of and in contacting relation with the first covers; a second hard plate having substantially the same size as the second cover and provided at the inner side of and in contacting relation with the second cover; and a third hard plate having substantially the same size as the third cover and integrally formed with the third cover, so that the first to third covers are reinforced by the first to third hard plates to maintain the contour of the shoulder baby bag.

The center strap of the baby holder may be provided at its drooped bottom portion with a generally rectangular pad for cosy fitting to the buttocks of a baby.

The tongue cover may be covered at its inner side with a soft cloth.

The above and other objects, features and advantages of the present invention will become clear from the following particular description of the invention and the appended claims, taken in conjunction with the accompanying drawings which show by way of example a preferred embodiment of the present invention.

Figure 1:
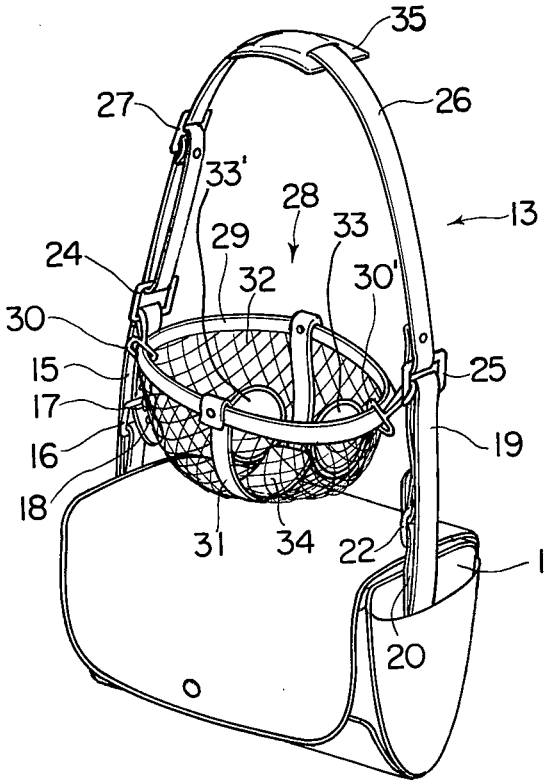
FIG. 1 is a schematic view of a shoulder baby bag embodying the present invention.
Figure 2:
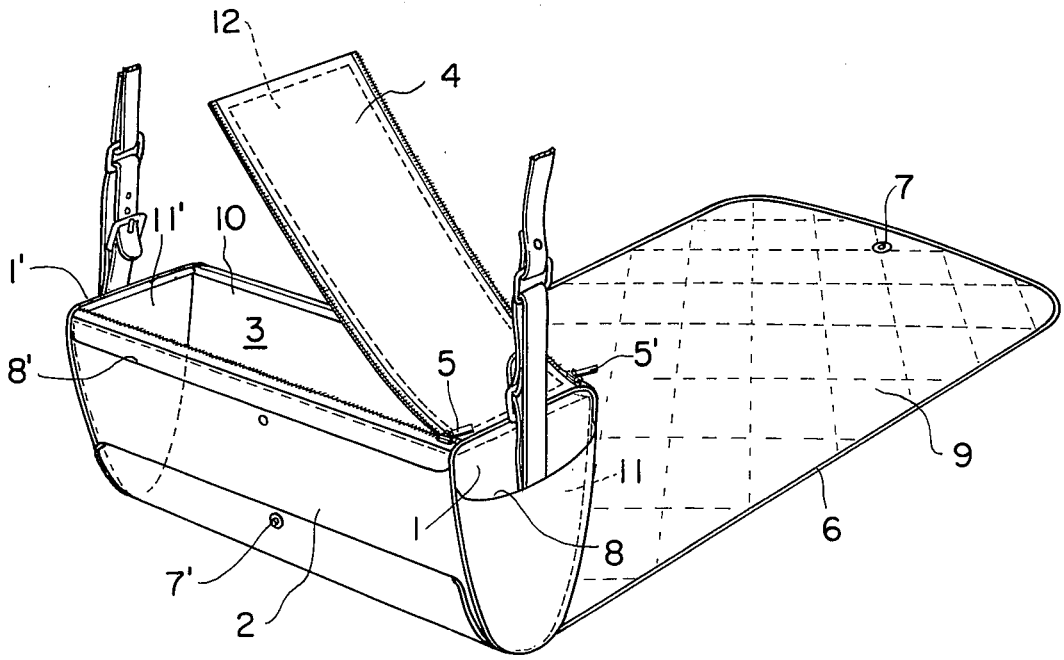
FIG. 2 is an enlarged schematic view of the shoulder baby bag shown in FIG. 1 but partly showing a shoulder strap thereof.
Figure 3:
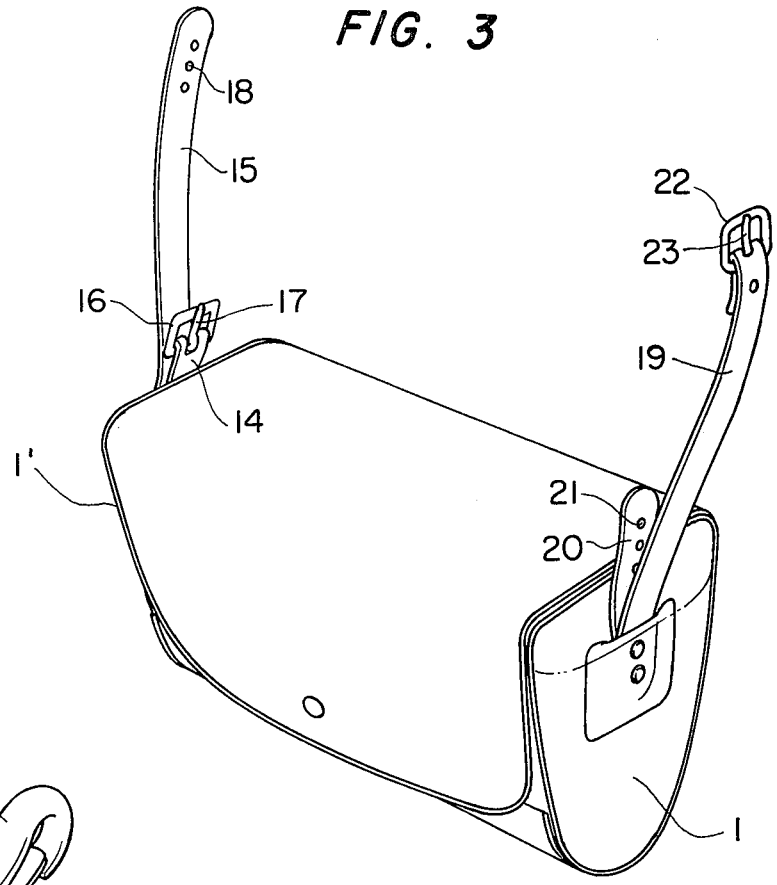
FIG. 3 is an enlarged schematic view of the shoulder baby bag shown in FIG. 1 but particularly showing first and second male and female straps attached in folded relation to first covers of the shoulder baby bag.

Referring now to the drawings and in particular to FIGS. 1 and 2, the reference numerals 1 and 1′ designate a pair of first covers which are made in the form of a generally inverted triangle and spaced apart from and in opposing association with each other. A second cover 2 is made in a generally rectangle and stitched to the side edges of said first covers 1 and 1′ for defining a cavity 3 with the first and second covers 1, 1′ and 2. A third cover 4 is also made in a generally rectangle and has one end stitched to the upper edge of the first covers 1 and side edges integrally connectable by zippers 5 and 5′ with the upper edges of the second cover 2. The third cover 4 further has the other ends extending to the upper edge of the remaining first cover 1′ and is swingable around the one end of the third cover 4 stitched to the upper edge of the first cover 1 when the side edges of the third cover 4 are dissociated or disengaged from the upper edges of the second cover 2. A tongue cover 6 is likewise made in the form of a generally rectangle and has one end stitched to the lower portion of the second cover 2 and the other end carrying a fastener 7 to be attached with another fastener 7′ on the one end of the tongue cover 6. The tongue cover 6 has a length sufficient to wrap the second cover 2 and the third cover 4. Each of the first covers 1 and 1′ is formed at its outer side with a pocket 8 and the second cover 2 is also formed at its outer side with a pocket 8′ for receiving articles such as diapers and papers. The tongue cover 6 is covered at its inner side with a soft cloth 9 to provide comfortableness to the baby when it is stretched as shown in FIG. 3 for lay or placing the baby thereon with a view to sleeping it and replacing its diaper and the like thereon. At this time, the second cover 2 serves as a pillow for the baby and the tongue cover 6 serves as a bed. In order to prevent the second cover 2 from being flat and to retain the pillow-like configuration of the second cover 2, there is provided at the inner side of and in contacting relation with the second cover 2 a second hard plate 10 which has substantially same size as the second cover 2. For the same reason, there are provided a pair of first hard plates 11 and 11′, respectively at the inner sides of and in contacting relation with the first covers 1 and 1′, each of which has substantially same size as the first covers 1 and 1′, while a third hard plate 12 having substantially same size as the third cover 4 is attached to the inner side of the third cover 4.

As a result, the first, second and third covers 1, 1′, 2 and 4 are reinforced by the first, second and third hard plates 11, 11′, 10 and 12, respectively. As shown in FIGS. 1 to 3, a shoulder strap, generally indicated at 13, comprises first male and female straps 14 and 15 which have one ends attached in folded relation with each other to the outer surface of the first cover 1′. The first male strap 14 is disposed between the first female strap 15 and the first cover 1′ and has the other end provided with a buckle 16 having a pin member 17, while the first female strap 15 is disposed outwardly of the first male strap 14 and has a plurality of holes 18 arranged in its longitudinal direction to be engageable with the pin member 17 of the buckle 16 of the first male strap 14. The first female strap 15 is made longer than that of the first male strap 14. The shoulder strap 13 further comprises second male and female straps 19 and 20 which have one ends also attached in folded relation with each other to the outer surface of the first cover 1. The second female strap 20 is disposed between the second male strap 19 and the first cover 1 and has a plurality of holes 21 arranged in its longitudinal direction while the male strap 19 has the other end provided with a buckle 22 having a pin member 23 to be selectively engageable with one of the holes 18 of the first female strap 15 and one of the holes 21 formed in the second female strap 20. The second male strap 19 is made longer than that of the second female strap 20. A first connecting intermediate connecting ring 24 in the form of a generally rectangle is held by the first male and female straps 14 and 15 with the pin member 17 of the buckle 16 of the first male strap 14 engaging one of the holes 18 of the female strap 15. A second intermediate connecting ring 25 in the form of a generally rectangle is also held by the second male and female straps 19 and 20 with the pin member 23 of the buckle 22 of the second male strap 19 engaging one of the holes 21 of the second female strap 20. A third strap 26 has one end held by the first intermediate connecting ring 24 and the other end held by the second intermediate ring 25 in such a manner that the third strap 26 is adapted to be adjustable along its longitudinal direction by a suitable adjusting member 27. A baby holder generally represented at 28 includes a ring strap 29 provided above the third cover 4 with a pair of locking devices 30 and 30′ to be securely connectable with the first and second intermediate connecting rings 24 and 25, the ring strap 29 being applied to the waist of the infant baby, a center strap 31 having both ends secured to the ring strap 27 to be drooped toward the third cover 4, and a net 32 formed into a generally inverted mountain shape and having an upper end secured to the entire length of the ring strap 29. The net 32 is formed with a pair of bores 33 and 33′ to be inserted by legs of a baby. The center strap 31 is provided at its drooped bottom portion with a generally rectangular pad 32 for cosy fitting to the buttocks of the baby. The third strap 26 of the shoulder strap 13 is also provided at its upper portion with a generally rectangular pad 35 for cosy fitting to the shoulder of a carrier.

Figure 4:
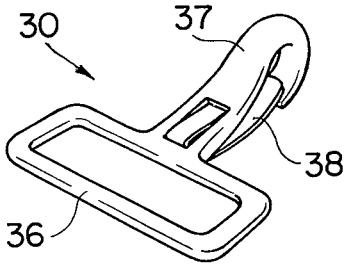
FIG. 4 is an enlarged schematic view of a locking device for locking baby holder and a shoulder strap.

FIG. 4 shows the locking device 30, made in substantially the same construction to the locking device 30′, which comprises a rectangular ring 36 receiving the ring strap 29 of the baby holder 28, a hook 37 integrally formed with the rectangular ring 36, and a plate spring 38 having one end securely connected to the rear end of the hook 37 and the other end engaged with the forward end of the hook 37. The locking devices 30 and 30′ engaged with the ring strap 29 of the baby holder 28 can thus be connected to the first and second intermediate rings 24 and 25, respectively, by forcing the rings 24 and 25 to be inserted between the forward end of the hook 37 and the other end of plate spring 38.

Figure 8:
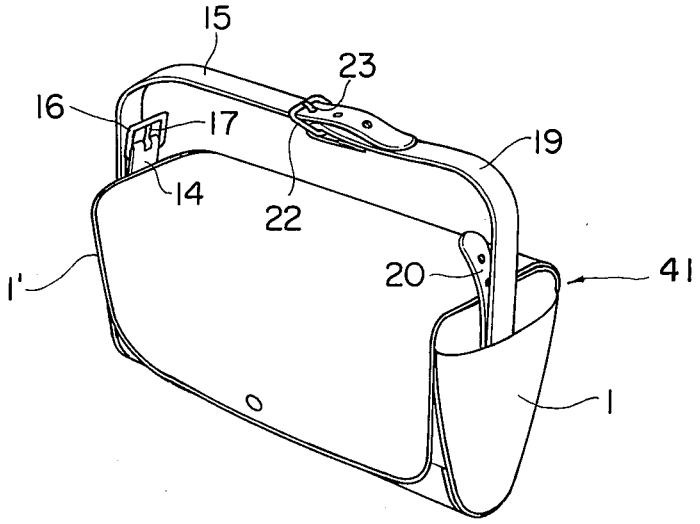
FIG. 8 is a schematic view of a shoulder baby bag which is removed from a baby holder and the shoulder strap for another usage.
Figure 5:
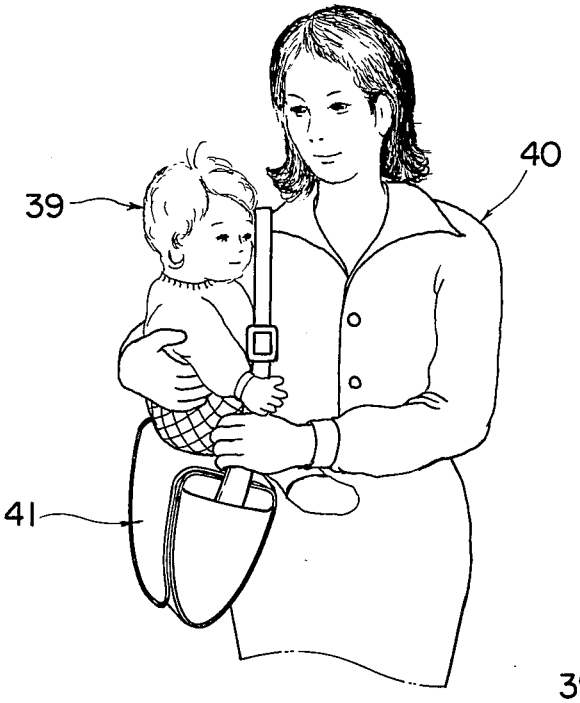
FIG. 5 is a view showing an infant or baby and the shoulder baby bag carried by a woman.
Figure 6:
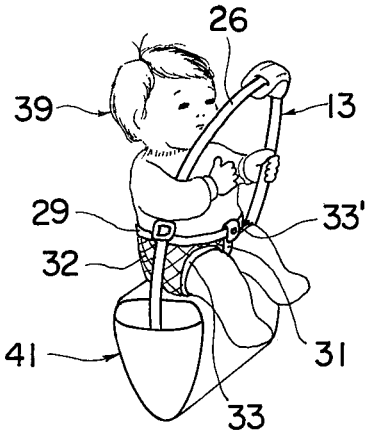
FIG. 6 is a similar view to FIG. 5 but showing only the infant baby and the shoulder baby bag.
Figure 7:
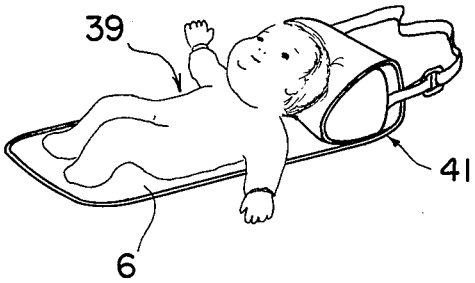
FIG. 7 is a schematic view of the shoulder baby bag with a tongue cover stretched to lay the baby thereon.

The shoulder baby bag of the present invention thus constructed will be used in such a way as described hereinafter.

Where a baby 39 is desired to be carried by a woman 40, she sits the baby 39 on the bag 41 after having the baby 39 to insert its legs 42 through the bores 33 and 33′ of the net 32 and carries the baby 39 and the bag 41 as shown in FIGS. 5 and 6. In order to sleep the baby 39 and replace its diaper on suitable places such as parks, benches and the like, the tongue cover 6 is stretched for a bed while the bag 41 is used a pillow for the baby 39 as shown in FIG. 7. Where the bag 41 is carried by any one, the bag 41 can be removed from the shoulder strap 13 and the baby holder 28. In this case, the first female strap 15 can be engaged with the second male strap 19 for the purpose of facilitating carriage of the bag 41 as shown in FIG. 8.

Although particular embodiments of the present invention have been shown and described, it will be obvious to those skilled in the art that various changes and modifications may be made without departing from the spirit and scope of the present invention.

What is claimed is:

1. A shoulder baby bag comprising: a pair of first covers having a generally inverted triangular shape and spaced apart from and in opposing relation with each other; a second cover having a generally rectangular shape and stitched to the side edges of said first covers for defining a cavity with said first and second covers; a third cover having a generally rectangular shape and having one end stitched to the upper edge of one of said first covers and having its side edges attachable to the upper edges of said second cover with zippers, said third cover further having the other end extending to the upper edge of the remaining first cover and being swingable around said one end of said third cover when said side edges of said third cover is dissociated from the upper edges of said second cover; a tongue cover having a generally rectangular shape and having one end stitched to the lower portion of said second cover and the other end fastenable to said one end with a sufficient length to wrap said second cover and third cover; and a shoulder strap having ends secured to the upper portions of said first covers whereby said tongue when unwrapped serves as a bed and said first, second and third covers serve as a pillow.

2. A shoulder baby bag as defined in claim 1, in which said shoulder strap comprises first male and female straps which have one ends attached in folded relation with each other to the outer surface of one of said first covers, said first male strap being disposed between said first female strap and one of said first covers and having the other end provided with a buckle having a pin member, and said first female strap being disposed outwardly of said first male strap and having a plurality of holes arranged in its longitudinal direction to be engageable with said pin member of said buckle of said first male strap and having a length longer than that of said first male strap; second male and female straps which have one ends attached in folded relation with each other to the outer surface of the remaining first cover, said second female strap being disposed between said second male strap and the remaining first cover and having a plurality of holes arranged in its longitudinal direction, and said second male strap having the other end provided with a buckle having a pin member to be selectively engageable with one of said holes formed in said first female strap and one of said holes formed in said second female strap and having a length longer than that of said second female strap; a first intermediate connecting ring held by said first male and female straps with said first male strap engaging said first female strap; a second intermediate connecting ring held by said second male and female straps with said second male strap engaging said second female strap; and a third strap having one end held by said first intermediate connecting ring and the other end held by said second intermediate ring with its longitudinal length adjustable.

3. A shoulder baby bag as defined in claim 2, which further comprises a baby holder having both ends lockably engaged with said first and second intermediate connecting rings to hold a baby on said third cover.

4. A shoulder baby bag as defined in claim 3, in which said baby holder including a ring strap provided above said third cover with a pair of locking devices to be connectable with said first and second intermediate connecting rings, a center strap having both ends secured to said ring strap to be drooped toward said third cover, and a net formed into a generally inverted mountain shape and having an upper ends secured to the entire length of said ring strap, said net being formed with a pair of bores to be inserted by legs of a baby.

5. A shoulder baby bag as defined in claim 4, in which said center strap is provided at its drooped bottom portion with a generally rectangular pad for cosy fitting to the buttocks of a baby.

6. A shoulder baby bag as defined in claim 1, which further comprises: a pair of first hard plates each having substantially the same size as said first covers and respectively provided at the inner sides of and in contacting relation with said first covers; a second hard plate having substantially the same size as said second cover and provided at the inner side of and in contacting relation with said second cover; and a third hard plate having substantially the same size as said third cover and integrally formed with said third cover, so that said first to third covers are reinforced by said first to third hard plates to maintain the contour of the shoulder baby bag.

7. A shoulder baby bag as defined in claim 1, which further comprises a pocket formed at the outer side of each of said first covers.

8. A shoulder baby bag as defined in claim 1, in which said tongue cover is covered at its inner side with a soft cloth.

9. A shoulder baby bag as defined in claim 1, in which said second cover having at its outer side at least one pocket.

10. A shoulder baby bag as defined in claim 1, in which said shoulder strap is provided at its upper portion with a generally rectangular pad for cosy fitting to the shoulder of a carrier.

* * * * *